US009194589B2

(12) United States Patent
Dondurur et al.

(10) Patent No.: US 9,194,589 B2
(45) Date of Patent: Nov. 24, 2015

(54) CONTROL KNOB FOR STOVES AND OVENS

(75) Inventors: Mehmet Dondurur, Dhahran (SA); Ahmet Z. Sahin, Dhahran (SA)

(73) Assignee: KING FAHD UNIVERSITY OF PETROLEUM AND MINERALS, Dhahran (SA)

( * ) Notice: Subject to any disclaimer, the term of this patent is extended or adjusted under 35 U.S.C. 154(b) by 1323 days.

(21) Appl. No.: 13/026,010

(22) Filed: Feb. 11, 2011

(65) Prior Publication Data

US 2012/0204854 A1 Aug. 16, 2012

(51) Int. Cl.
*F24C 3/12* (2006.01)
*F24C 15/00* (2006.01)
*F24C 7/08* (2006.01)

(52) U.S. Cl.
CPC ..... *F24C 15/00* (2013.01); *F24C 7/085* (2013.01)

(58) Field of Classification Search
CPC ..... G05G 1/00; G05D 23/027; G05D 23/08; G05D 23/128; G05D 23/12; G05D 23/1905; F24C 3/128; F24C 15/00; F24C 7/085; F23N 5/027; F23N 2035/24
USPC ... 236/15 A, 46 D, 51; 126/1 R, 19 R, 273 A, 126/273 R, 273.5, 274, 275 E, 275 R, 276; 392/310; 219/391
See application file for complete search history.

(56) References Cited

U.S. PATENT DOCUMENTS

| | | | | |
|---|---|---|---|---|
| 2,192,600 | A | 3/1940 | Lurtz | |
| 2,472,795 | A * | 6/1949 | Dunn | 236/1 R |
| 2,810,525 | A | 10/1957 | Wantz | |
| 3,032,636 | A | 5/1962 | Schauer, Jr. | |
| 3,302,001 | A | 1/1967 | Frazier | |
| 3,362,635 | A * | 1/1968 | Forte | 236/46 R |
| 3,738,354 | A | 6/1973 | Aries et al. | |
| 4,287,583 | A | 9/1981 | Strachan et al. | |
| 2002/0113062 | A1 | 8/2002 | Cranford | |

FOREIGN PATENT DOCUMENTS

| | | |
|---|---|---|
| GB | 986942 | 3/1965 |

* cited by examiner

*Primary Examiner* — Frantz Jules
*Assistant Examiner* — Azim Abdur Rahim
(74) *Attorney, Agent, or Firm* — Richard C. Litman

(57) ABSTRACT

The control knob for stoves and ovens includes a timer coupled with an automatic power shut-off feature and that also includes a control for setting the temperature of the stovetop burner or oven. A single knob or controller having a variety of embodiments is disclosed and incorporates both the timer and a temperature controller. After the set time has expired, the oven or burner is turned off. An alarm is also provided to indicate that the time has expired.

3 Claims, 8 Drawing Sheets

CONTROL KNOB FOR STOVES AND OVENS

BACKGROUND OF THE INVENTION

1. Field of the Invention

The present invention relates generally to electrical control systems for appliances, and particularly to a control knob for stoves and ovens that combines a temperature control and a timer coupled with an automatic power shut-off feature into a single control knob assembly.

2. Description of the Related Art

Traditional oven and burner knobs have a timer and temperature control buttons or gas control buttons that operate separately and independently. If the user sets the time and the temperature or gas level, cooking will continue until the user intervenes, unless the oven or stove has an automatic shut off feature. Otherwise the oven or burner will continue supplying the heat, thereby posing a threat to human life. However, such control systems require using separate knobs, push buttons, or the like for setting the temperature and setting the timer. Digital controls that are not collocated are capable of timing and controlling ovens, but generally not capable of timing and controlling stoves, and the control for setting timing is separate from the control for setting temperature.

Thus, a control knob for stoves and ovens solving the aforementioned problems is desired.

SUMMARY OF THE INVENTION

The control knob for stoves and ovens includes a timer coupled with an automatic power shut-off feature and that also includes a control for setting the temperature of the stovetop burner or oven. A single knob or controller having a variety of embodiments is disclosed and incorporates both the timer and a temperature controller. After the set time has expired, the oven or burner is turned off. An alarm is also provided to indicate that the time has expired.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The control knob for stoves and ovens includes a timer coupled with an automatic power shut-off feature, and which also includes a control for setting the temperature of the stove burner or oven. A single knob or controller having a variety of embodiments is disclosed and incorporates both the timer and a temperature controller. After the set time has expired, the oven or the burner is turned off. An alarm is also provided to indicate that the time has expired.

Figure 1:
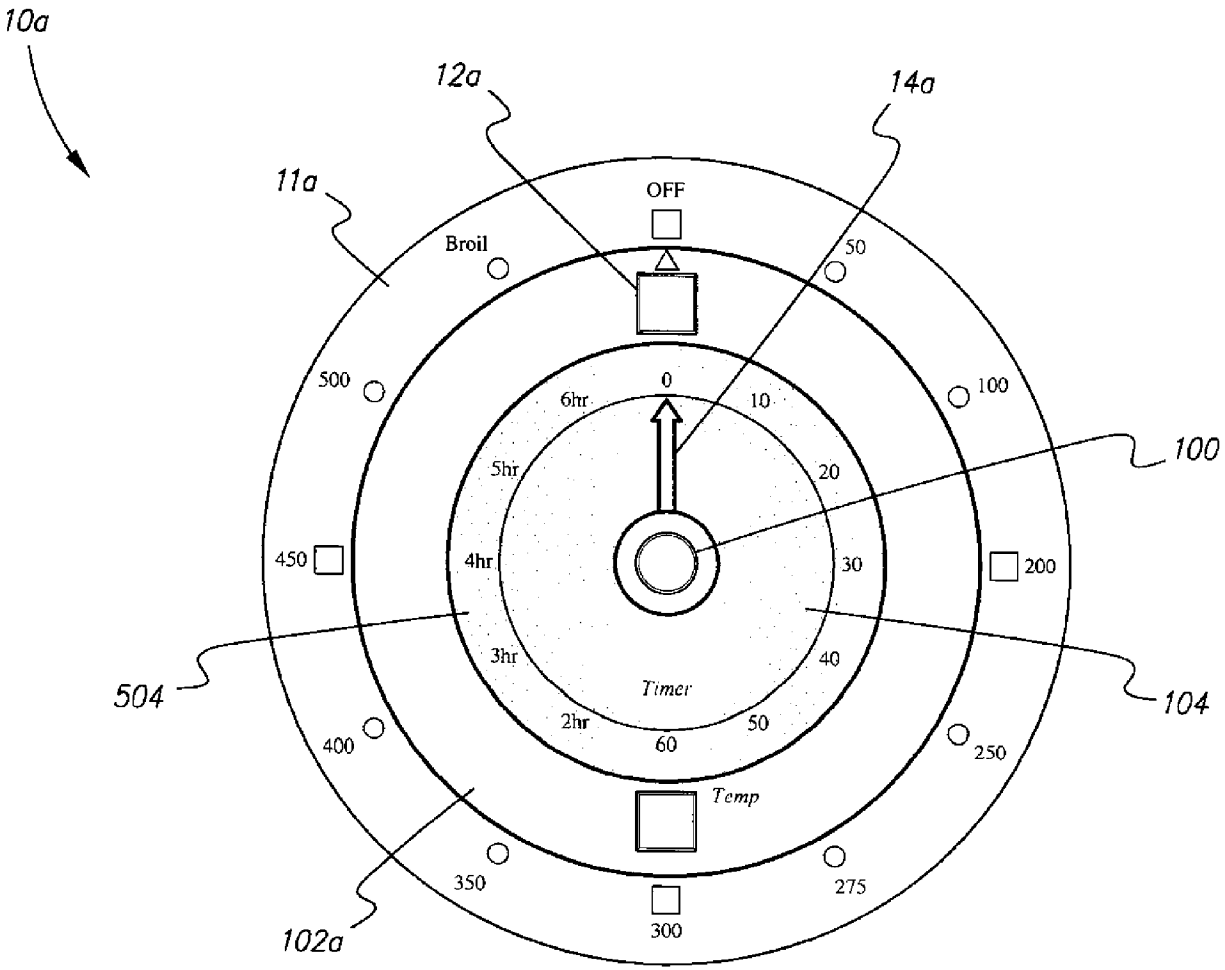
FIG. 1 is a front view of a first embodiment of a control knob for stoves and ovens according to the present invention.

Referring to the control knob assembly 10*a* shown in FIG. 1, embedded electric oven and stove knobs 10*a* are disclosed in which both temperature or heat source and timer dials are mixed, but they are represented with different, concentric circular members within the same knob. The heat indicia, ranging from OFF to a maximum heat setting, are disposed on a stationary circular planar member 11*a*. The temperature markings are numeric increments in degrees and a final "Broil" setting. A stationary ring 504 is arranged concentrically inside stationary circular planar member 11*a*. Time indicia are disposed on the stationary ring 504. A time control mechanism includes a rotatable circular planar member 104 disposed concentrically inside the stationary ring 504. A knob 100 and indicator arrow 14*a* are attached to the rotatable planar time controller 104 for rotation therewith. The timer indicia have a predetermined numerical time duration and increment.

Figure 5:
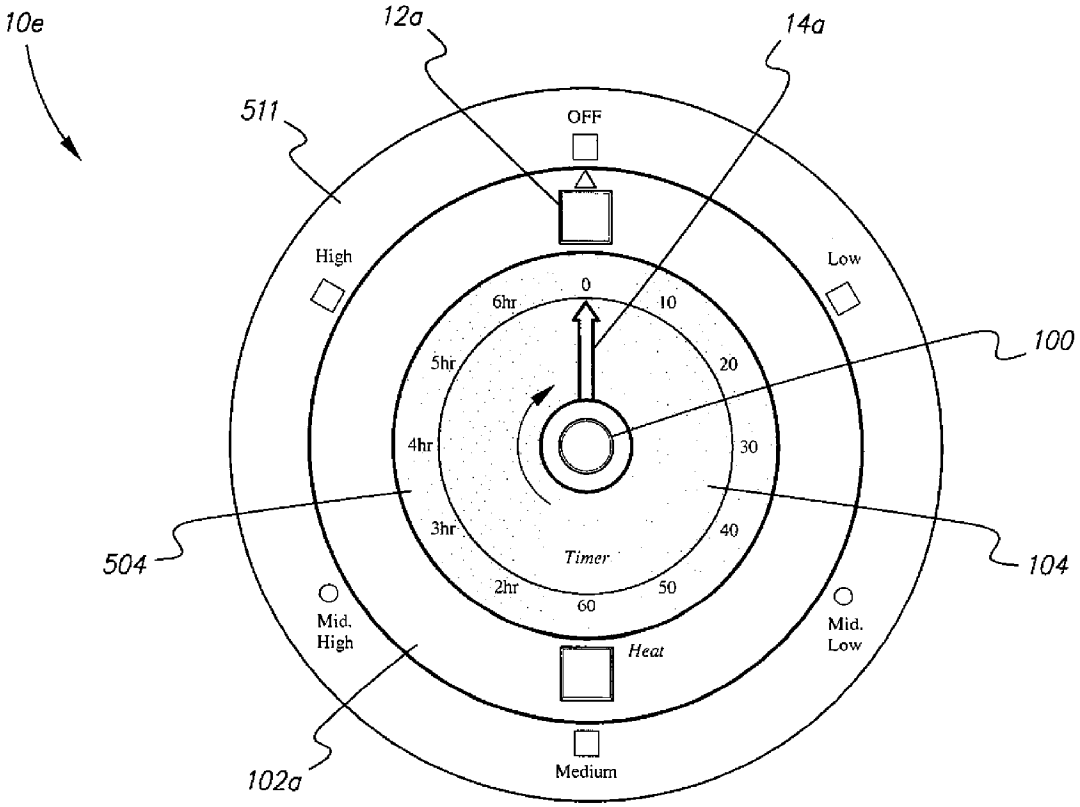
FIG. 5 is a front view of a fifth embodiment of a control knob for stoves and ovens according to the present invention.

The temperature control mechanism includes a rotatable temperature control ring 102*a* (or circular plate mounted beneath the rotatable timer member 104) that has a temperature control knob and indicator 12*a* attached thereto for rotation with the ring 102*a*. The rotatable temperature control ring 102*a* and rotatable circular planar member 104 are jointly mounted and linked such that a cooking heat element is energized at a heat set by the heat control mechanism only for a time duration set by the time control mechanism, after which the cooking heat element is shut off and the heat control knob 12*a* returns to "OFF". Referring now to the fifth embodiment control knob assembly 10*e* shown in FIG. 5, a similar control knob is disclosed except that control knob assembly 10*e* comprises a stationary circular planar member 511 that has heat indicia ranging from OFF to a maximum heat setting including control marks ranging from "Low" to "High", as pointed to by knob and indicator 12*a*, rather than having the heat setting marked by degrees.

Figure 2:
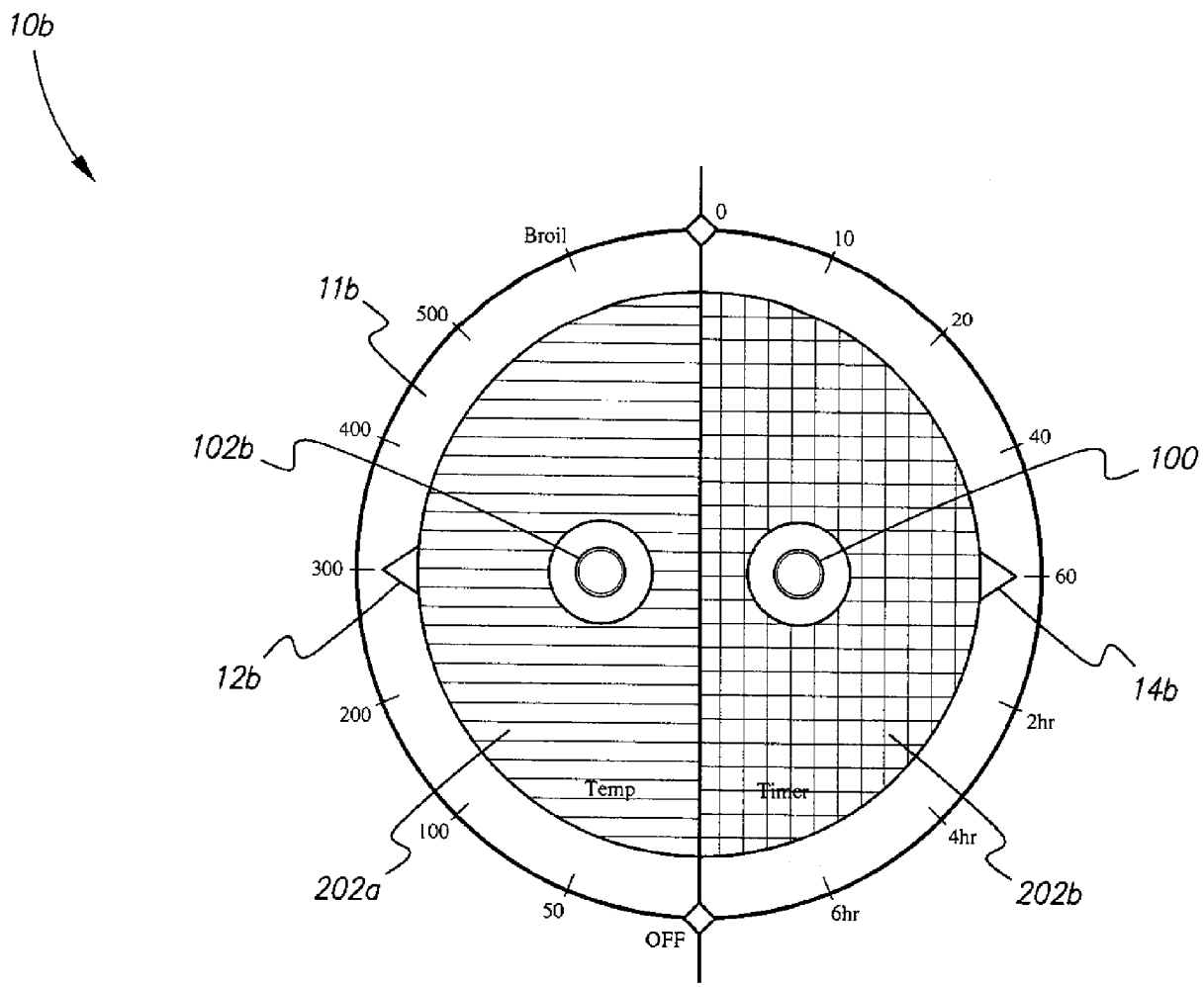
FIG. 2 is a diagrammatic front view of a second embodiment of a control knob for stoves and ovens according to the present invention.

Referring to the control knob assembly 10*b* shown in FIG. 2, divided electric oven and stove knobs are disclosed. A stationary circular planar member 11*b* has heat indicia arranged along or in close proximity to the left half circumferential edge of the stationary circular planar member 11*b*, and time indicia arranged along or in close proximity to the right half circumferential edge of the stationary circular planar member 11*b*. Indicia in the timer portion (right side) have a predetermined numerical time duration and increment, while indicia in the temperature portion (left side) have an "OFF" setting and then a predetermined numerical heat range and increment. The heat control mechanism includes a rotatable heat control semicircular or half disk 202*a* comprising a half circumference that is concentrically rotatable proximate the left half circumferential edge of the stationary circular planar member 11*b*. A heat control turning knob 102*b* is attached to a center portion of the rotatable heat control half disk 202*a*. The timer control mechanism includes a rotatable timer control half disk 202*b* comprising a half circumference that is concentrically rotatable proximate the right half circumferential edge of stationary circular planar member 11*b*. A timer control turning knob 100 is attached to a center portion of the rotatable timer control half disk 202*b*.

Figure 6:
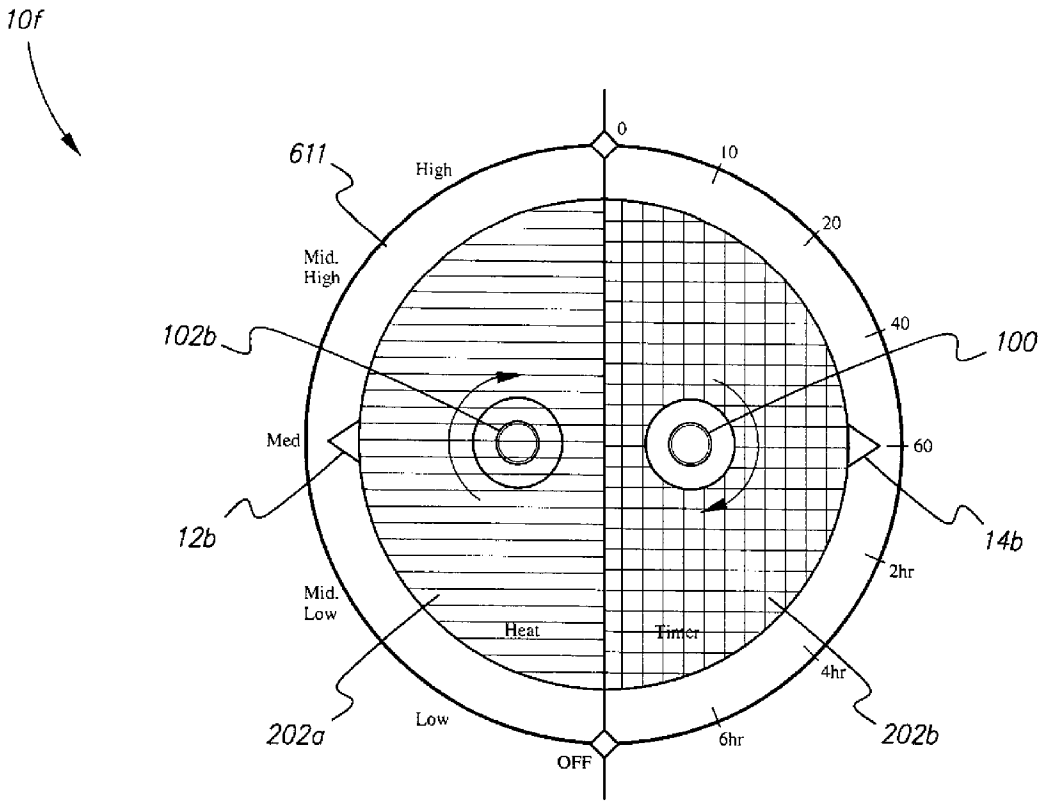
FIG. 6 is a diagrammatic front view of a sixth embodiment of a control knob for stoves and ovens according to the present invention.

The temperature control mechanism 202*a* and the timer control mechanism 202*b* are jointly mounted and linked such that a cooking heat element is energized at a heat set by the heat control mechanism only for a time duration set by the time control mechanism, after which the cooking heat element is shut off and the heat control indicator 12*b* returns to "OFF". Referring to the sixth embodiment control knob assembly 10*f*, shown in FIG. 6, a similar control knob is disclosed, except that the control knob assembly 10*f* comprises a stationary circular planar member 611 that has heat indicia ranging from OFF to a maximum heat setting including control marks ranging from "Low" to "High", as pointed to by temperature indicator 12*b*, instead of having the temperature settings marked in degrees.

Figure 3:
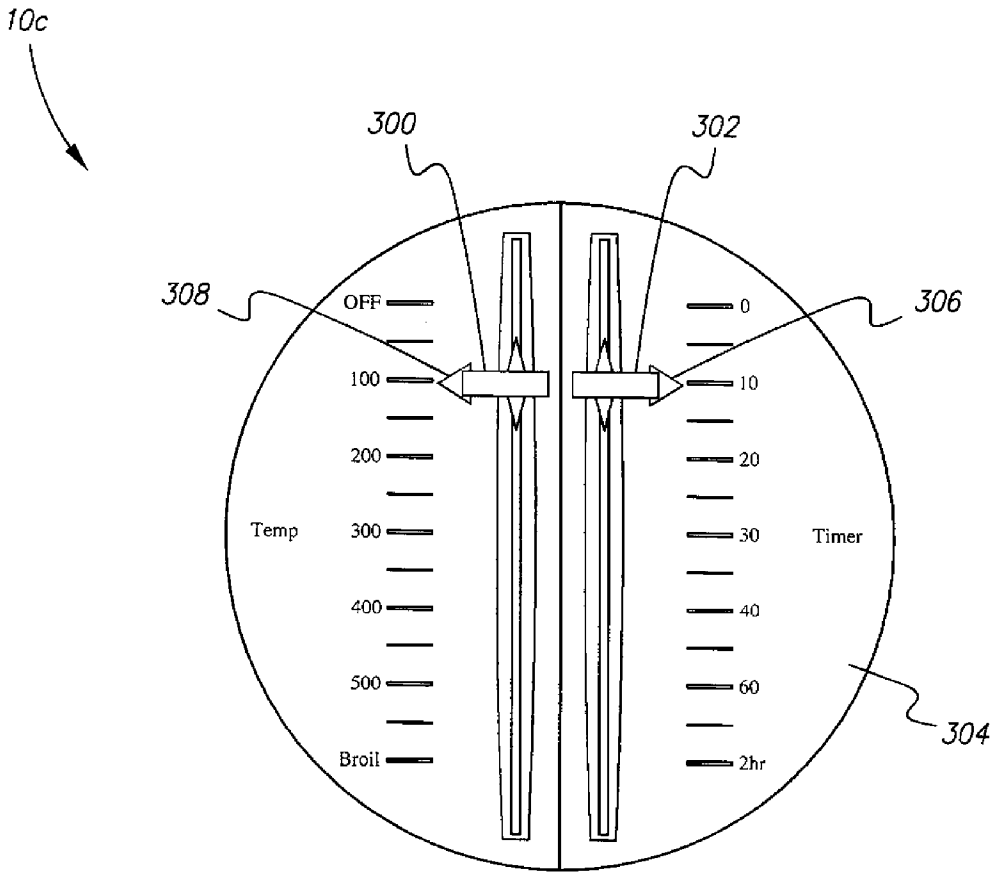
FIG. 3 is a front view of a third embodiment of a control knob for stoves and ovens according to the present invention.
Figure 7:
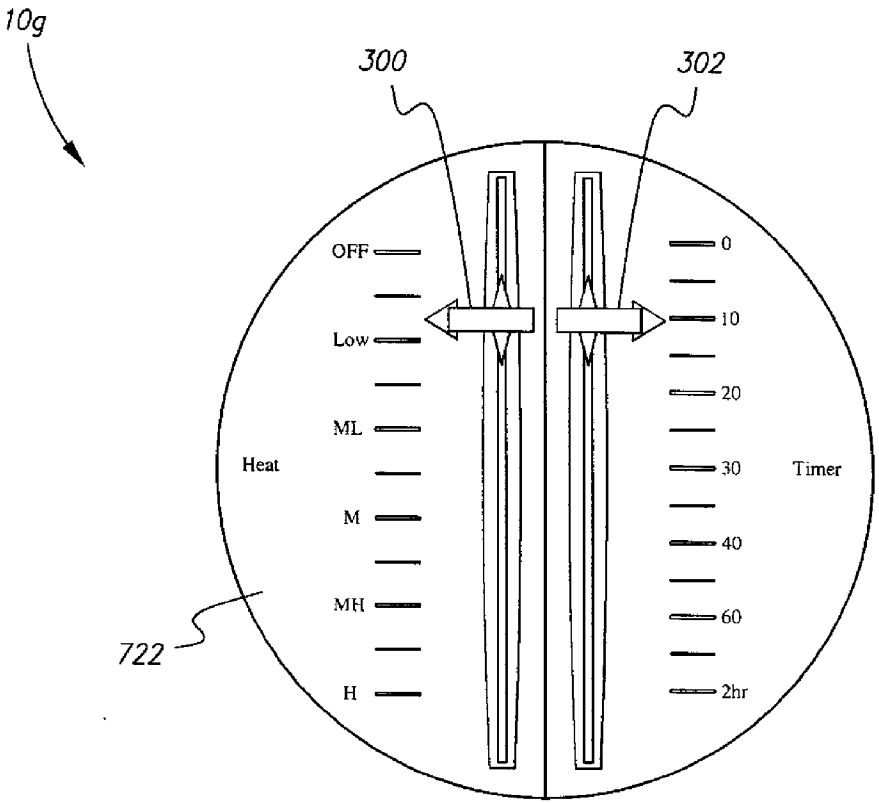
FIG. 7 is a front view of a seventh embodiment of a control knob for stoves and ovens according to the present invention.

In the control knob assembly 10*c* of FIG. 3, time indicia are arranged vertically from top to bottom on the right half portion of a stationary circular planar member 304. Heat indicia are arranged vertically from top to bottom on the left half portion of the stationary circular planar member 304. A heat control slider knob 300 is vertically disposed adjacent to the heat indicia on the left half portion of stationary circular planar member 304. A heat control indicator arrow 308 extends horizontally from the slider knob 300 and points toward the heat indicia on the left half portion of the stationary circular planar member 304. A timer control slider knob 302 is vertically disposed adjacent to the time indicia on the right half portion of the stationary circular planar member 304. A timer control indicator arrow 306 extends horizontally from the slider knob 302 and points toward the timer indicia on the right half portion of the stationary circular planar member 304. The timer indicia have a predetermined numerical time duration and increment. The temperature markings are numeric increments in degrees and a final "Broil" setting. The user sets the timer and temperature using slider knobs 302 and 300. The temperature control slider knob 300 and the timer control slider knob 302 are jointly mounted and linked such that a cooking heat element is energized at a temperature set by the heat control mechanism only for a time duration set by the timer control mechanism 302, after which the cooking heat element is shut off, returning slider knob 300 and heat control indicator 308 to "OFF". Referring to the control knob assembly 10*g* shown in FIG. 7, a similar, control knob is disclosed, except that the control knob assembly 10*g* comprises a stationary circular planar member 722 that has heat indicia ranging from OFF to a maximum heat setting including control marks ranging from "Low" to "High", as pointed to by slider knob 300 and indicator 308.

Figure 4:
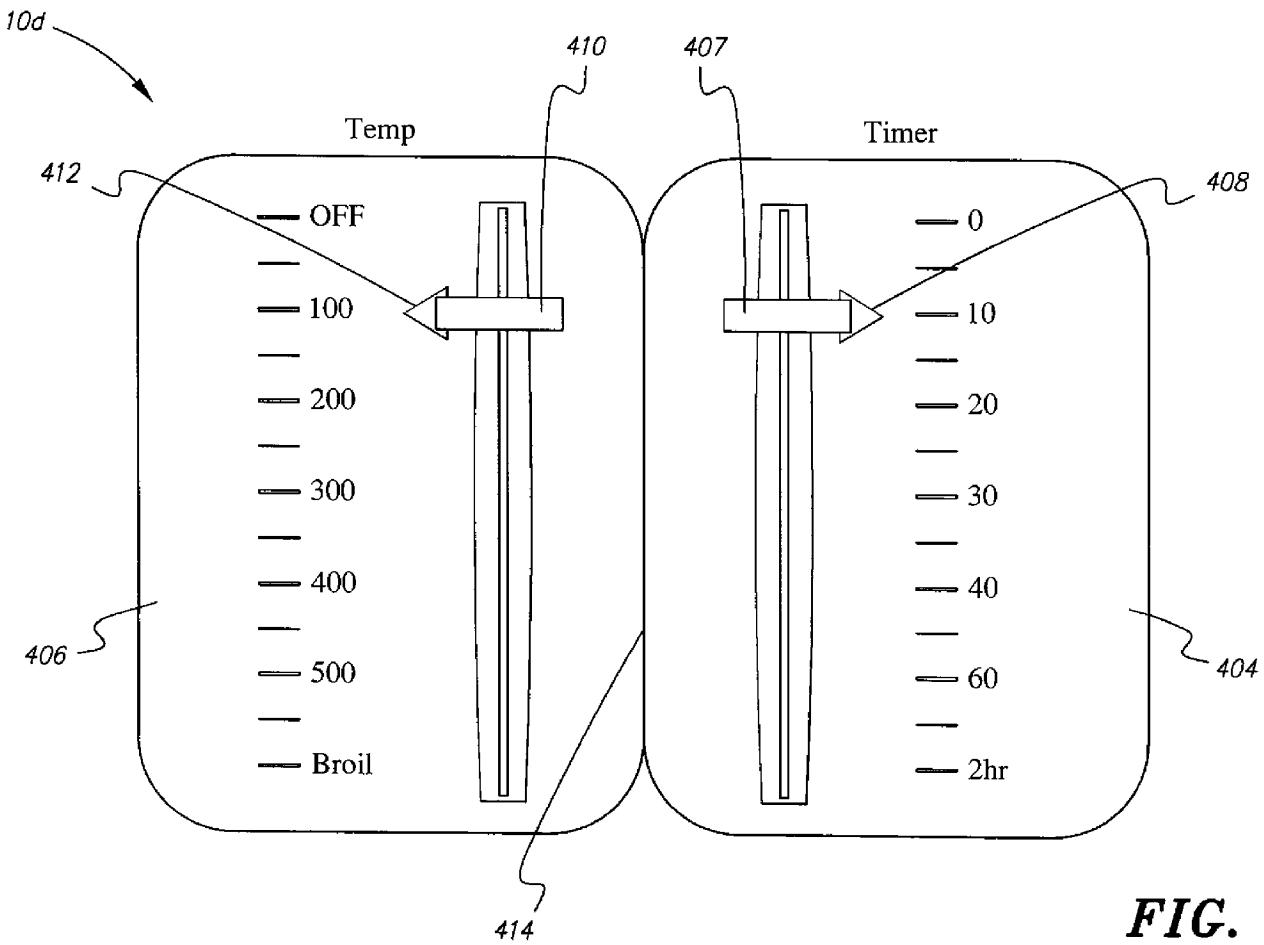
FIG. 4 is a front view of a fourth embodiment of a control knob for stoves and ovens according to the present invention.
Figure 8:
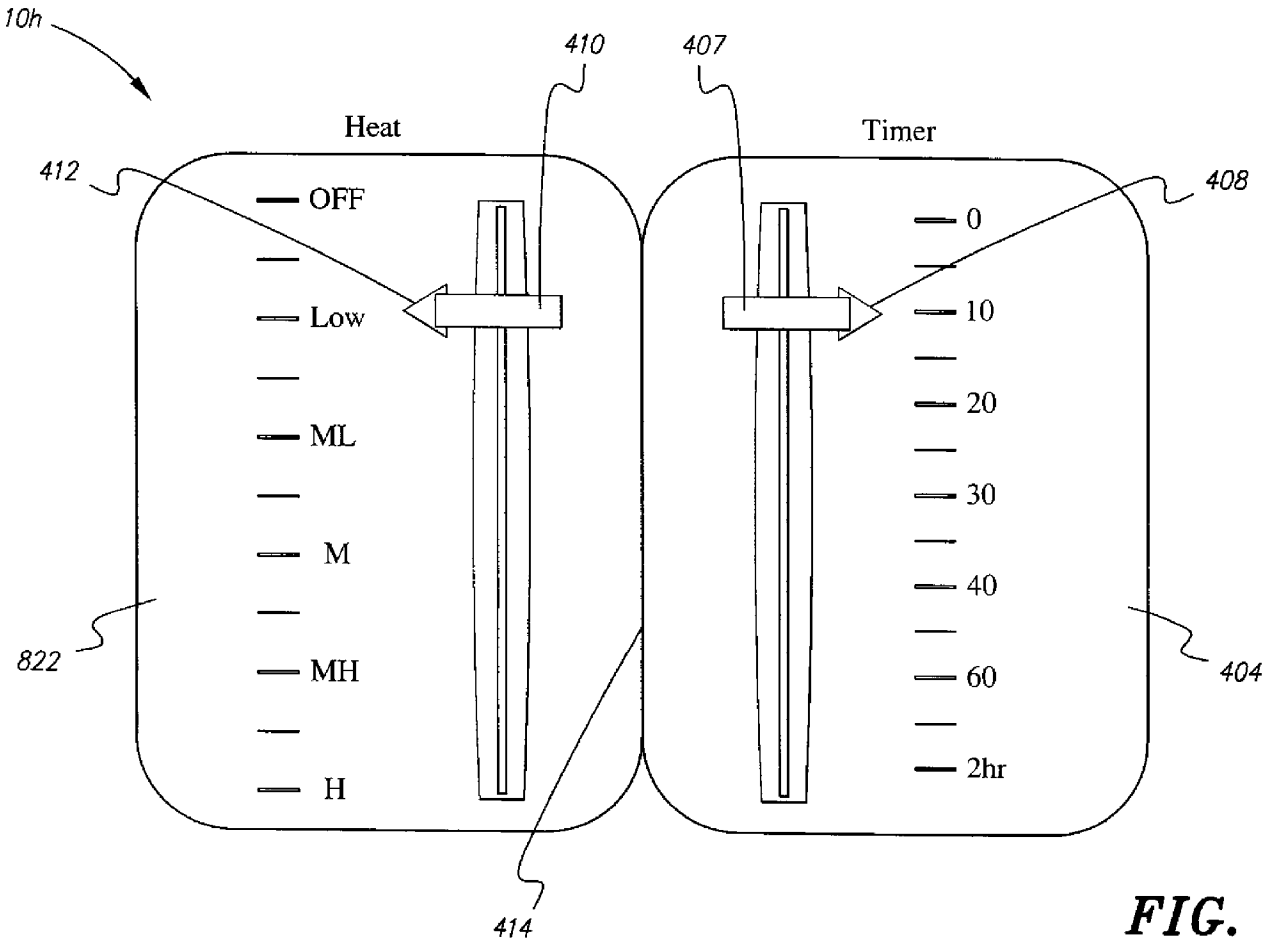
FIG. 8 is a front view of an eighth embodiment of a control knob for stoves and ovens according to the present invention.

Referring to the control knob assembly 10*d* shown in FIG. 4, there is a right-side substantially rectangular planar member 404 adjacent to a left-side substantially rectangular planar member 406, the members 404 and 406 having rounded edges. Adjacency of the planar members 404, 406 forms inside lengthwise edge 414. Heat indicia are arranged vertically from top to bottom on the left-side substantially rectangular planar member 406. A heat control slider knob 410 is vertically disposed adjacent to the heat indicia on the left-side substantially rectangular planar member 406. A heat control indicator 412 extends horizontally from the slider knob 410 and points toward the heat indicia on the left-side substantially rectangular planar member 406. A timer control slider knob 407 is vertically disposed adjacent to the time indicia on the right-side substantially rectangular planar member 404. A timer control indicator 408 extends horizontally from the slider knob 407 and points toward the timer indicia on the right-side substantially rectangular planar member 404. The timer indicia have a predetermined numerical time duration and increment. The temperature markings are numeric increments in degrees and a final "Broil" setting. The user sets the timer and temperature using slider knobs 407 and 410. The temperature control slider knob 410 and the timer control slider knob 407 are jointly mounted and linked such that a cooking heat element is energized at a temperature set by the heat control mechanism only for a time duration set by the timer control knob 407, after which the cooking heat element is shut off, returning slider knob 410 and heat control indicator 412 to "OFF". Referring to the control knob assembly 10*h* shown in FIG. 8, a similar control knob is disclosed, except that the control knob assembly 10*h* comprise a left-side substantially rectangular planar member 822 that has heat indicia ranging from OFF to a maximum heat setting including control marks ranging from "Low" to "High", as pointed to by slider 410 and indicator 412, instead of temperature markings in degrees.

It is to be understood that the present invention is not limited to the embodiments described above, but encompasses any and all embodiments within the scope of the following claims.

We claim:

1. A control knob assembly for stoves and ovens, comprising:

a stationary circular planar member;

heat indicia ranging from OFF to a maximum heat setting disposed on the stationary circular planar member;

a heat control mechanism disposed inside a circumference of the stationary circular planar member; and a time control mechanism disposed inside the circumference of the stationary circular planar member, the time control mechanism being linked to the heat control mechanism;

wherein a cooking heat element is energized at a heat set by the heat control mechanism only for a time duration set by the time control mechanism, after which the cooking heat element is de-energized, returning the heat control mechanism to an off position.

2. The control knob assembly for stoves and ovens according to claim 1, wherein said heat indicia is arranged proximate to an entire circumferential edge of said stationary circular planar member.

3. The control knob assembly for stoves and ovens according to claim 2, wherein said heat indicia further comprises numeric indicia of a thermal degree baking temperature and indicia of a Broil temperature setting.

* * * * *